United States Patent [19]

Wetzel

[11] 4,262,731

[45] Apr. 21, 1981

[54] FOUNDRY MOLDING-APPARATUS AND METHOD

[75] Inventor: Friedrich Wetzel, Allmersbach, Fed. Rep. of Germany

[73] Assignee: A. Stotz Aktiengesellschaft, Stuttgart, Fed. Rep. of Germany

[21] Appl. No.: 26,075

[22] Filed: Apr. 2, 1979

[30] Foreign Application Priority Data

Apr. 1, 1978 [DE] Fed. Rep. of Germany ..... 2814140

[51] Int. Cl.[3] ..... B22D 15/22

[52] U.S. Cl. ..... 164/19; 164/201

[58] Field of Search ..... 164/200–202, 164/19–22, 7, 160, 165, 166, 12, 16

[56] References Cited

U.S. PATENT DOCUMENTS

| | | | |
|---|---|---|---|
| 3,229,336 | 1/1966 | Hunter et al. | 164/200 |
| 3,726,954 | 4/1973 | Munk et al. | 164/200 |
| 3,760,866 | 9/1973 | Larkin | 164/200 |
| 3,807,483 | 4/1974 | Bühler | 164/202 |
| 4,126,176 | 11/1978 | Muller et al. | 164/201 |

*Primary Examiner*—Gil Weidenfeld
*Assistant Examiner*—K. Y. Lin
*Attorney, Agent, or Firm*—Becker & Becker

[57] ABSTRACT

A foundry molding-apparatus and method with at least one sand delivery device in communication with a mold chamber having at least one sand inlet opening and air exit opening, and provided by a mold box, a sand frame, at least one pattern plate carrying the mold box, and at least one mold head which is mounted at the apparatus, axially spaced from the pattern plate, and includes a perforated press plate. With respect to the pattern plate, the sand frame and the sand delivery device are together vertically adjustably movable with respect to the pattern plate and guided by a guide means mounted about the apparatus relative to the central longitudinal axis of the apparatus. The opening of the sand delivery device extends transversely to the longitudinal central axis of the apparatus. The passage leading to the mold chamber extends at an angle to the central longitudinal axis of the apparatus.

16 Claims, 14 Drawing Figures

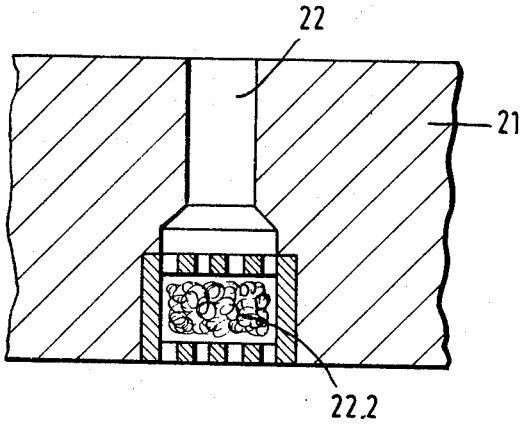
Fig.4
Fig.5
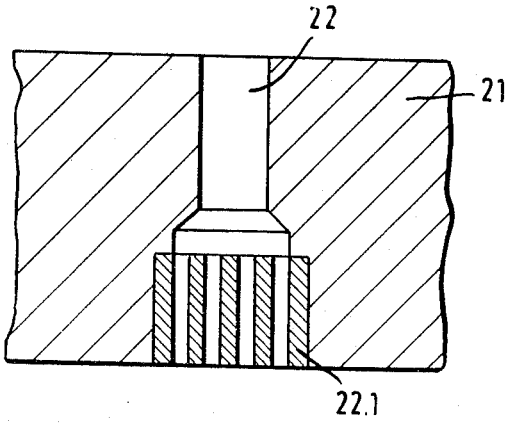

FOUNDRY MOLDING-APPARATUS AND METHOD

The present invention relates to foundry molding-apparatus. More particularly, the present invention relates to foundry molding-apparatus with at least one sand delivery device in communication with a mold chamber having at least one sand inlet opening and at least one air outlet opening. The mold chamber of the apparatus is defined by a mold box, a sand frame, at least one vertically movable pattern plate adapted to carry the mold box, and at least one stationary mold head mounted in the apparatus, axially spaced from the pattern plate, and including a perforated press plate. The invention also relates to the method of supplying and compacting mold sand.

In previously known apparatus of U.S. Pat. No. 3,807,483—Bühler dated Apr. 30, 1974, the sand frame is usually not much higher than the press plate, since it is laid out for a filling height corresponding to a specific sand frame height. In such an apparatus, accordingly, only a predetermined filling volume can be supplied to the mold chamber. Furthermore, in this prior art apparatus, the sand frame is movable with respect to the sand delivery device, and the sand inlet openings and air exit openings are provided by the perforations in the press plate, and by additional apertures in the mold box and in the pattern plate. The air escaping on introduction of the sand, accordingly, moves substantially in the direction of the sand flow, and a relatively large quantity of said passing through the air exit openings is lost with the air stream leaving the mold chamber. Thus, optimal filling of the mold chamber cannot be obtained.

Furthermore, additional quantities of sand can leave the mold chamber through the sand inlet openings of the known apparatus, which openings have to be relatively large in order to achieve high throughputs, so that the filling volume is further reduced. Escaping sand can adhere in the sand inlet openings, whereby the operation is impaired. Finally, the pressure surface of the press plate of the previously known apparatus is reduced, because of the relatively large openings, and its effectiveness is relatively small; and compaction of the sand is not sufficiently uniform. It is, furthermore, relatively expensive and labor intensive to provide the air exit openings in the mold box and in the pattern plate of such previously known apparatus.

It is an object of the present invention to provide a foundry molding-apparatus in a constructively simple manner so that filling of the mold chamber is attained even at random succession of form boxes with varying heights.

This object and other objects and advantages of the invention will appear more clearly from the following specification in connection with the accompanying drawings, in which:

FIGS. 2A, 3A, 4 and 5 show details of apparatus in accordance with the present invention.

The foundry molding-apparatus of the invention is characterized primarily by a sand frame and a mold sand delivery device which are jointly, vertically shiftably guided relative to the press plate by means of a guide secured in the apparatus and by sand inlet openings extending with the pertaining orifice cross section transversely to the longitudinal central axis of the apparatus in the sand frame.

The sand frame and the sand frame delivery device are jointly and positively guided by a guide so as to be vertically shiftable. Thus, the sand frame can be relatively high and adaptation of randomly high mold boxes, having considerably varying heights, is simply and quickly attained. For this, the sand frame and the sand delivery device are moved relative to the mold head through such a distance that an optimal amount of mold sand can be supplied to the mold chamber. The positive guiding furthermore ensures a close contact and an accurate alignment of the sand frame with respect to the mold box and the mold head, so that the mold chamber is efficiently sealed against dust losses. Because of this, a uniform and high degree of compaction is also attained. The relative arrangement of the sand inlet openings and the air exit openings, furthermore, substantially prevents leakage of sand through the openings, since the air exit openings are provided above the sand inlet openings, so that escaping air, on filling the mold chamber, is propitiously, aerodynamically, removed. Sand is not appreciably deflected from its entry direction by the air moving in a cyclonic pattern and is not passed through the air exit openings so as to be ejected from the mold chamber. In accordance with one aspect of the invention, all material components such as mold head, and mold box, are axially aligned, so that the filling, compacting, and final compacting are readily and smoothly carried out in the apparatus. Thus, the apparatus is constructively simple in design and of compact construction, by means of which, primarily, is achieved the rigid connection of the sand frame and the sand delivery device. With the apparatus in accordance with the invention, furthermore, each working cycle is of very short duration and the progress of the operation is substantially uninterrupted. Furthermore, the apparatus can be economically produced, and can be subsequently installed in existing mold installations and conveyor-like production installations which utilize mold boxes.

Figure 1:
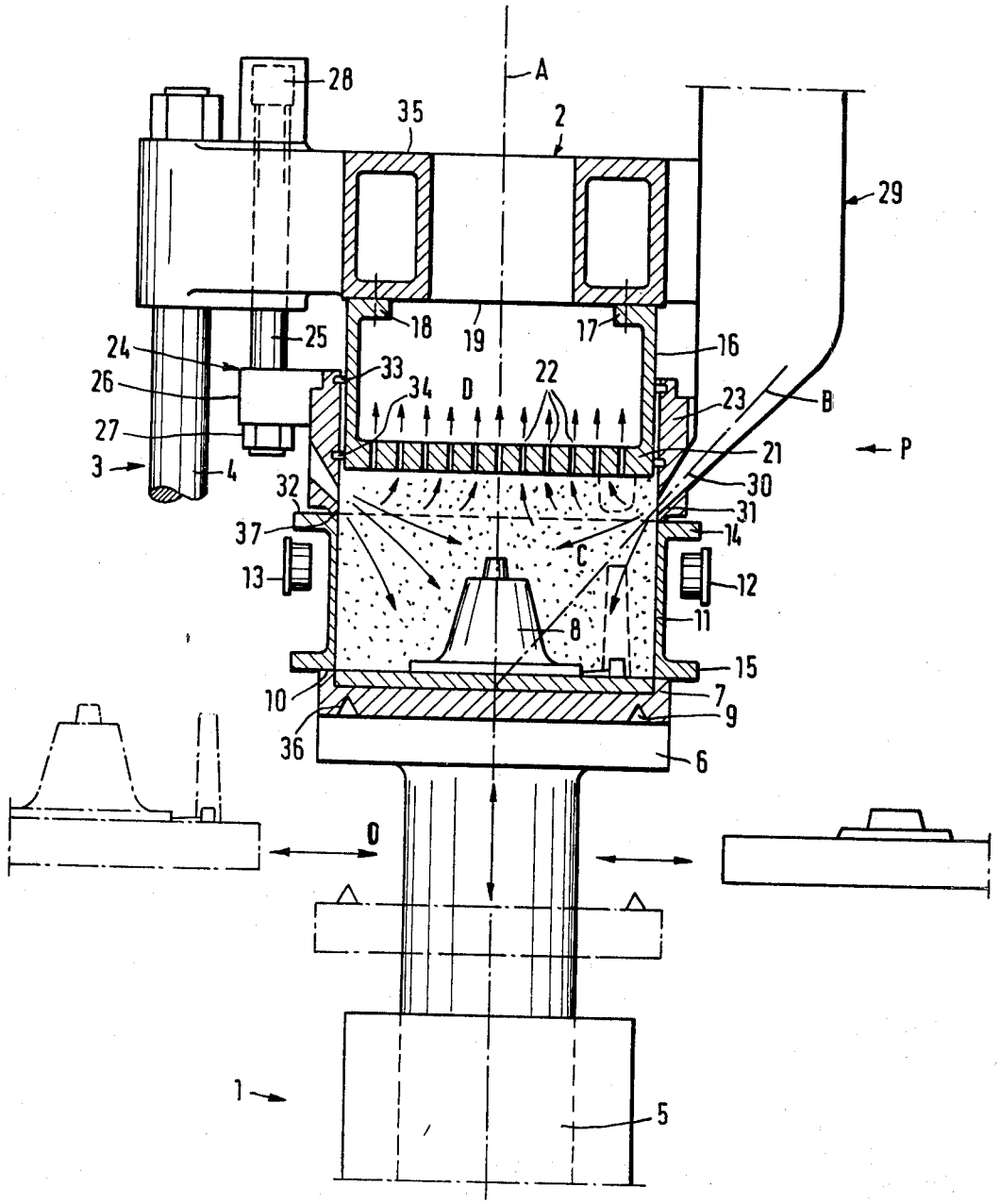
FIG. 1 is a diagrammatical side elevational view, partly in section, a part of a foundry molding-apparatus in accordance with one embodiment of the invention.

Referring now particularly to the drawings, the apparatus generally comprises a base member 1 and a horizontally disposed yoke member 2. The base member 1 and the yoke member 2 are combined by a support structure 3 including four vertical columns 4 (of which only one is shown in FIG. 1). In the base member 1 a press piston 5 is arranged which carries on an upper carrying plate 6 a pattern plate 7 in which a pattern or model 8 is form-lockingly held. The pattern plate 7 is securely positioned by means of projections 9 provided on the carrying plate 6 to prevent longitudinal shifting thereof. For carrying out molding or forming, a mold box 11 is positioned on the upper rim 10 of pattern plate 7. The mold box 11 can be delivered to the apparatus by means of lateral rollers 12 and 13, diagrammatically indicating a delivery roller conveyor. Upon completion of the molding operation, the mold box 11 can be removed from the apparatus in the direction perpendicular to the viewing plane of FIG. 1. The mold box 11 comprises an upper horizontal flange 14 and a lower horizontal flange 15, both outwardly directed, for support on the rollers 12 and 13.

A mold head 16 having an outer contour corresponding generally to the inner contour of the mold box 11 is arranged in the yoke member 2, the latter being formed as a generally rectangular frame having a hollow, generally rectangular cross section. As is indicated in the vertical section in FIG. 1, the mold head 16 is generally U-shaped, and is bolted with inwardly directed leg extensions 17 and 18 to the underside 19 of the yoke member 2. The cross member 21 of mold head 16 is in the form of a perforated press plate with evenly distributed, relatively small air exit openings 22 on its entire surface. The opening provided by an air exit opening 22 is relatively small, in comparison to the distance between the adjacent openings 22 extending parallel to the axis A of the apparatus. Thus, ejection of sand with the escaping air stream is substantially avoided. Furthermore, due to the small dimensioned air exit openings 22, the effective pressure surface and, thereby the operation of the apparatus are enhanced. Furthermore, advanced and uniform compacting is assured.

A sand frame 23 is provided movably in yoke member 2, in line with the mold box 11 and is vertically adjustable, by means of guide 24, relative to press plate 21 and mold head 16. The sand frame 23, the mold box 11, the press plate 21, and the pattern plate 7 provide a mold chamber which receives the pattern 8.

The guide 24 is provided by vertically extending columns, of which only one is shown in FIG. 1, a lower ledge 26, and an upper ledge 28, the latter limiting the operational movement of the guide rods 25. Means for moving the sand frame independently of the pattern plate include at least one piston or move specifically four hydraulically actuated pistons uniformly distributed about the apparatus relative to the longitudinal axis thereof. The sand frame 23 is secured to the lower ledges 26, the latter being in the form of radially outwardly directed flanges. The length of a guide rod 25 is selected in such a way that the sand frame 23, which has generally the same height as the mold head 16, can be moved in the direction of axis A, for a sufficient distance; thus, the sand frame 23 has a considerable useful height. The guide rods 25 are uniformly distributed about axis A in the direction of the mold head 16 in the molding-apparatus, or in the yoke member 2, and are positioned inwardly of the columns 4 of the support structure 3.

Figure 2A:
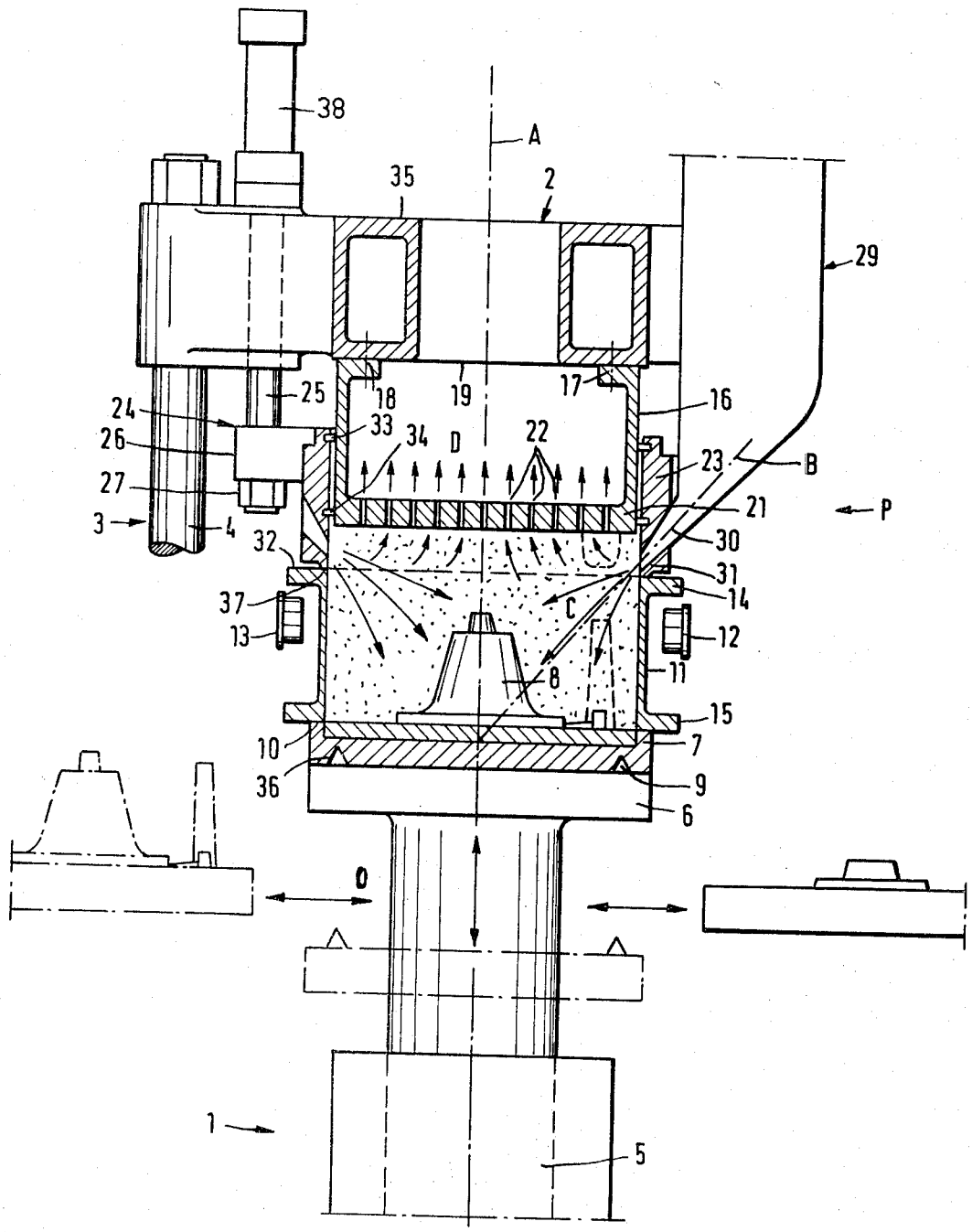
Figure 3A:
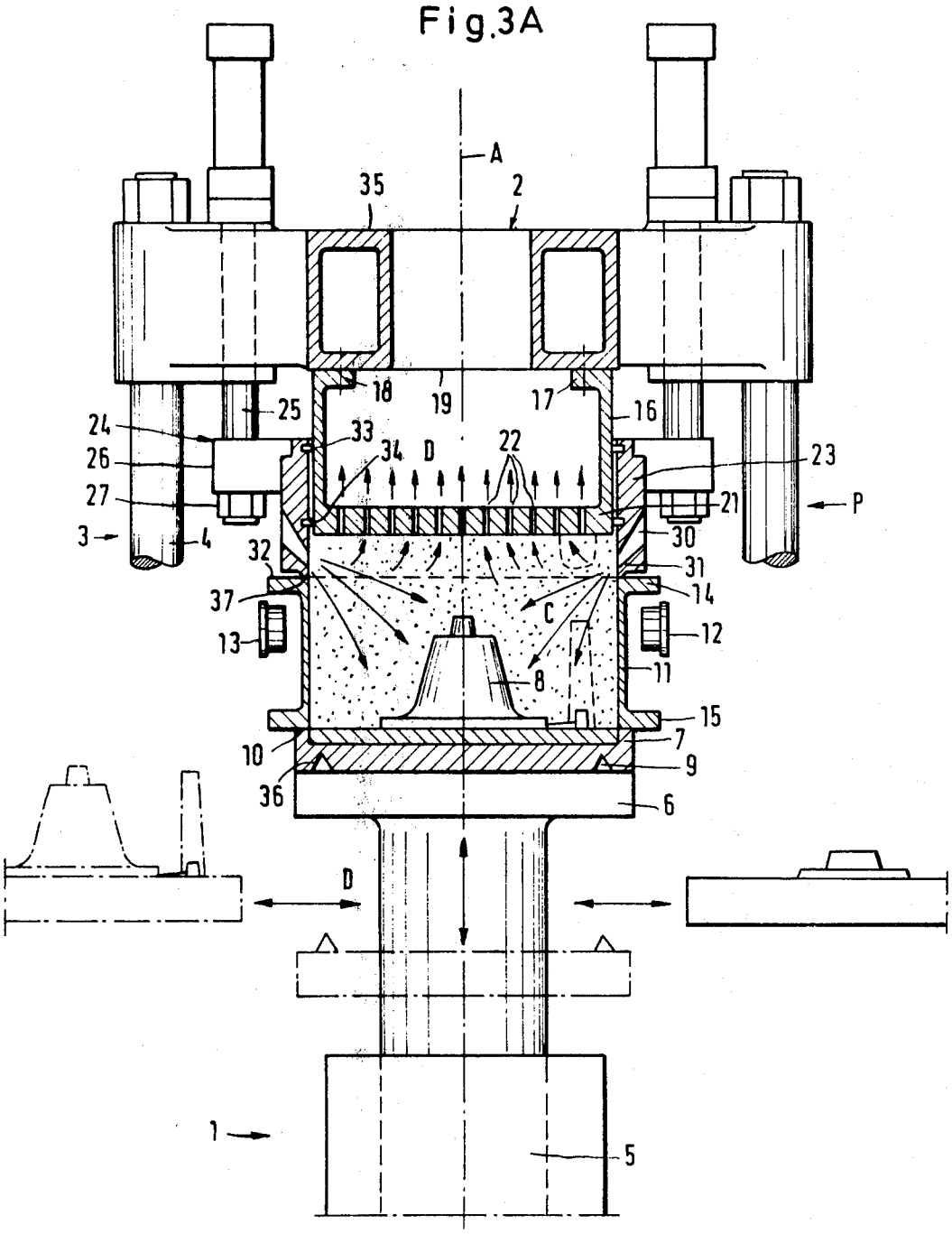

In order to actuate the sand frame 23 independently of press piston 5, a separate actuating device can be provided, which preferably includes hydraulically actuated, control cylinder and piston means 38, 38A, 38A' (FIGS. 2 and 3), which are to be arranged in place of the guide rods.

Preferably two sand delivery devices 29 are rigidly connected to the sand frame 23, which sand delivery devices 29 are provided at the same height of the sand frame 23, and positioned opposite of each other when viewed transversely to axis A of the apparatus. Each of the sand delivery devices 29 is in communication with an upper sand container and at least one unit for feeding gas under pressure, both not shown, so that mold sand, fluidized in the sand container, can be brought into the mold chamber under pressure, preferably by blowing. The sand delivery devices 29 include a downwardly reducing nozzle-like exit part 30 which leads into pertaining slot-like through openings 31 of the sand frame 23 and extends along an axis B at an angle, preferably an angle of 75°, to the axis A of the apparatus. The nozzle-like exit part 30 can also lead horizontally to the axis A of the apparatus into the mold chamber of the molding-apparatus. In side elevation (in the direction of arrow P) the exit parts 30, respectively, can be divided into two nozzles embracing a pointed or lip angle, which nozzles are, respectively, downwardly of somewhat increased width. The sand inlet openings provided by the parts 30 discharge nozzle-like at the lower end of the sand frame 23 into the mold chamber. The openings 31 in sand frame 23 extend approximately over the median height thereof, so that they can be relatively high. The mold chamber can be quickly and completely filled, due to the described formation and arrangement of the sand inlet openings in the mold chamber, and the sand is particularly uniformly precompacted. The compaction during compacting or pressing is therefore particularly uniform, because the air exit openings 22 are provided by the perforations of the press plate 21, so that air can escape unhampered in upward direction. Thus, an aerodynamically enhanced air stream is achieved, appreciable amounts of sand are not ejected with the air from the mold chamber, and the air escape passages are not blocked, while the desired sand volume is maintained.

Since the sand frame 23 and the mold sand delivery devices 29 are movable together in vertical direction and, as well, due to the formation and arrangement of the sand inlet openings 31, the filling height and, thereby, the filling capacity of the sand frame 23 can be adapted in a functionally simple manner to the height of the boxes at hand.

For this, the sand frame 23 and the sand delivery devices 29 are moved upwardly, prior to the introduction of sand, at positioning of the mold box 11 at the upper face 32, by means of the press piston 5 and the guide rods 25, until attaining the required filling height.

When the sand frame 23 and the sand delivery devices 29 are moved by hydraulically actuated pistons, the filling height of the sand frame 23 can be varied independently of the press piston 5. The press piston 5 can then be dimensioned for a lesser capacity or load. Furthermore, less demands are made of the individual components of the apparatus. When using hydraulically actuated pistons, also a particularly secure positioning of the sand frame 23 at the mold box 11 and a precise returning of the sand frame to its lower end position, upon completion of the pressing and lowering operation, are attained. In order to avoid even minor sand losses, inserts, particularly filter 22.2 or sifting 22.1 means can be provided for the air exit openings 22 of the press plate 21.

For sealing of the sand frame 23 relative to the mold head 16, two seals 33 and 34 are provided approximately at mid height of the sand frame 23 and at its upper end, respectively.

Figure 1A:
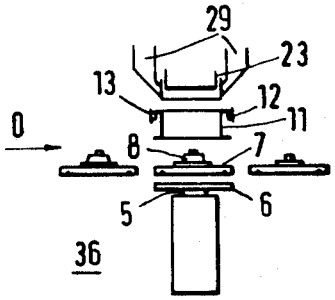
FIGS. 1*a* to 1*i* indicate diagrammatically successive operating steps of the embodiment shown in FIG. 1.
Figure 1B:
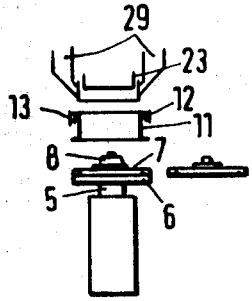
Figure 1C:
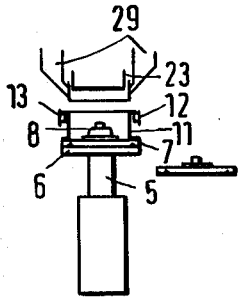
Figure 1D:
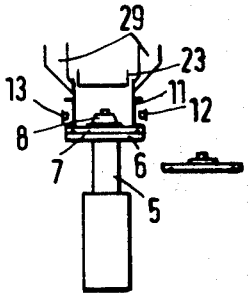
Figure 1E:
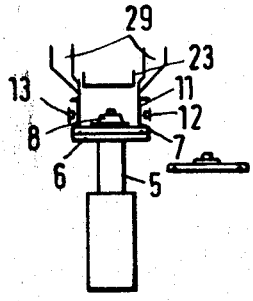
Figure 1F:
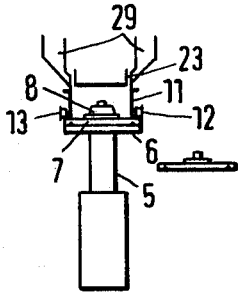
Figure 1G:
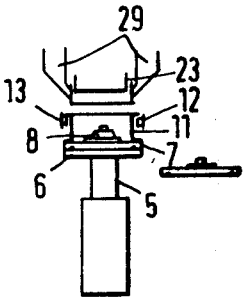
Figure 1H:
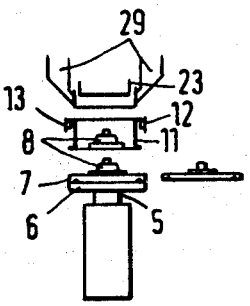
Figure 1I:
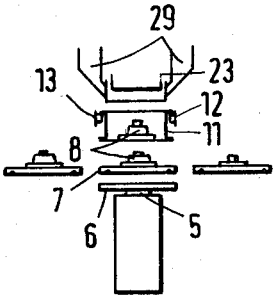

FIGS. 1*a* and 1*i* diagrammatically indicate a working cycle. In the initial position (FIG. 1*a*) the sand frame 23 and the press piston 5 are in their lowermost or retracted position, respectively, in which the upper ledge 28 of the guide rods 25 is in contact with the upper surface 35 of the yoke member 2. The mold box 11 is then positioned at a distance below the yoke member 2 in the the apparatus, into which it is moved by the roller conveyor 12, 13, to be aligned relative to the mold head 16. In this position it rests with its upper horizontal flange 14 on the rollers 12 and 13. Furthermore, left pattern plate 7 (FIGS. 1 and 1*a*) with pattern 8 is moved in the direction indicated by arrow O into the apparatus, to be at a distance below the mold box 11. In the next step (FIG. 1*b*), the press piston 5 is extended for a distance sufficient to engage with its carrying plate 6 and its projections 9 into the pertaining detent openings 36 of the pattern plate 7. The press piston 5 is subsequently further upwardly advanced, until in contact with the mold box 11 (FIG. 1*c*). The press piston 5 is then further extended until the upper face 32 of the mold box 11 is sealingly engaging the lower face (FIG. 1) of the sand frame 23. The mold box is thereby lifted off the rollers 12 and 13 and its inner wall provides, together with that of the sand frame 23, the wall of the mold chamber (FIG. 1*d*).

The sand frame 23 is now moved vertically by means of the press piston 5, the pattern plate 7 and the mold box 11 and the actuating cylinders, if such are used; this provides an operating means which is independent of the press piston 5 for the sand frame 25, until a desired filling height is attained, which is in conformity to the height of the pertaining mold box 11 (FIG. 1*e*). The sand frame 23, thereby, glides with its seals 33 and 34 sealingly along the mold head 16 and is accurately guided by the guide means.

The mold chamber can now be filled by the sand delivery devices 29, whereby fluidized sand flows through the sand inlet openings 30 nearly transversely to the axis A of the apparatus in the direction of the arrow C (FIG. 1), and, simultaneously air contained in the mold chamber and entrapped in the sand, is passed in the direction of the arrows D, through the air exit openings 22, upwardly, into the space above the press plate 21. An aerodynamically enhanced flow performance of the sand and the air is hereby attained, so that only a negligible amount of sand is ejected from the mold chamber through the air exit openings 22. The sand is introduced at a particularly favorable angle, so that it will not predominantly impinge on the pattern 8, or only to an acceptable extent. Thus, the surface of the pattern is protected and an even pattern surface is ensured.

The press piston 5 is then further extended for pressing or compacting to assume the position indicated in FIG. 1*f*.

Upon completion of the pressing operation, the direction of the press piston 5 is reversed and the mold box 11 is lowered to its lowermost position (FIG. 1*g*), while moving clear the sand frame 23, which assumes its initial position. On further lowering of the press piston 5, also pattern plate 7 is lifted off the mold box 11 (FIG. 1*h*), until it reaches, in its end position, the height of the pertaining pattern plate provided outside of the apparatus, ready for use, on a transverse transport conveyor. Finally, the press piston 5 is retracted to its lowermost position, whereby it also releases the pattern plate and in which the sand frame 23 reaches its lowermost, initial, position (FIG. 1*i*). The pattern plate 7 and the mold box 11 can now be transported out of the apparatus, and exchanged in a known manner, whereby the mold box 11 is removed by a newly introduced mold box. The apparatus is then ready for the next operating cycle.

It is, of course, to be understood that the present invention is in no way limited to the specific disclosure and showing of the drawings but also encompasses any modifications within the scope of the appended claims.

What I claim is:

1. A foundry molding-apparatus for forming a mold from a pattern, comprising in combination:

a mold head fixed to said apparatus, said mold head including a perforated press plate and having a longitudinal axis;

a walled sand frame coaxially arranged around said mold head and movable relative thereto, said walls of said sand frame including inlet means for passing mold sand therethrough, the cross-sectional opening of said inlet means being located below air discharge and extending transversely to the longitudinal axis;

a mold box movable relative to and along the axis of said mold head and adapted to support said sand frame shiftable in height;

a pattern plate for carrying a pattern and supporting said mold box, said pattern plate being movable relative to and along the longitudinal axis of said mold head;

at least one molding sand delivery means operatively connected to said sand frame for supplying molding sand to said sand inlet means; and means for independently moving said sand frame and said at least one delivery means relative to said mold head.

2. A foundry molding-apparatus in combination according to claim 1, wherein said means for moving said mold sand frame and said at least one sand delivery means include at least two guiding means uniformly distributed about said apparatus relative to said central longitudinal axis.

3. A foundry molding-apparatus in combination according to claim 1, which includes means for moving said sand frame independently of said pattern plate.

4. A foundry molding-apparatus in combination according to claim 3, wherein said means includes at least one piston.

5. A foundry molding-apparatus in combination according to claim 4, wherein said means includes four hydraulically actuated pistons uniformly distributed about said apparatus relative to said longitudinal axis thereof.

6. A foundry molding-apparatus in combination according to claim 1, wherein said inlet means extends at an angle oblique to said central axis of said apparatus.

7. A foundry molding-apparatus in combination according to claim 6, wherein said angle is approximately 75°.

8. A foundry molding-apparatus in combination according to claim 1, wherein said inlet means comprises at least one passage which narrows towards said central axis.

9. A foundry molding-apparatus in combination according to claim 8, wherein each of said passages comprises a nozzle of said at least one mold sand delivery means.

10. A foundry molding-apparatus in combination according to claim 1, comprising two mold sand delivery means located at the same level of and at opposite sides of said central longitudinal axis.

11. A foundry molding-apparatus in combination according to claim 1, wherein said mold head and said sand frame are in sealing contact.

12. A foundry molding-apparatus in combination according to claim 11, wherein the relative dimensions of said mold head and of said sand frame are approximately equal axially thereof.

13. A foundry molding-apparatus in combination according to claim 11, and further comprising seals axially spaced from one another and operatively connected to said sand frame.

14. A foundry molding-apparatus in combination according to claim 1, wherein the cross-sectional dimension of perforations of said perforated press plate is substantially less than the distance between adjacent perforations when viewed transverse to said longitudinal central axis.

15. A foundry molding-apparatus in combination according to claim 1, wherein said press plate includes inserts, particularly filters and sieves.

16. In a method of supplying and compacting of mold sand in foundry molding apparatus providing a mold chamber which is defined by a mold head, a sand frame, a mold box, and a pattern plate the steps in combination therewith comprising axially displacing at least the sand frame along a longitudinal axis relative to the mold head to adjust the volume of the chamber;

supplying mold sand to the mold chamber in a direction transverse to the axis in such a way that air contained in the mold chamber and in the mold sand leaves the chamber in a direction substantially parallel to the longitudinal axis in the direction away from the pattern plate; and compacting the mold sand.

* * * * *